US005153374A

United States Patent [19]

Gabriels

[11] Patent Number: 5,153,374

[45] Date of Patent: Oct. 6, 1992

[54] PROJECTILES

[75] Inventor: A. Gabriels, Genk, Belgium

[73] Assignee: Fabrique Nationale Nouvelle Herstal, en abrégé FNNH, société anonyme, Herstal, Belgium

[21] Appl. No.: 765,947

[22] Filed: Sep. 26, 1991

[30] Foreign Application Priority Data

Nov. 14, 1990 [BE] Belgium ..... 9001073

[51] Int. Cl.[5] ..... F42B 12/00

[52] U.S. Cl. ..... 102/484

[58] Field of Search ..... 102/374, 483, 484, 485; 42/105

[56] References Cited

U.S. PATENT DOCUMENTS

| | | | |
|---|---|---|---|
| 3,479,956 | 11/1969 | Birkigt | 102/374 |
| 3,537,398 | 11/1970 | Dauban | 102/484 |
| 3,934,513 | 1/1976 | Gabriels | 102/485 |
| 4,394,836 | 7/1983 | Chavee et al. | 102/485 |
| 4,448,129 | 5/1984 | Gabriels | 102/484 |
| 4,793,259 | 12/1988 | Ambrosi et al. | 102/485 |
| 4,846,070 | 7/1989 | Gabriels | 102/488 |

FOREIGN PATENT DOCUMENTS

| | | |
|---|---|---|
| 804791 | 1/1974 | Belgium . |
| 2554049 | 6/1977 | Fed. Rep. of Germany . |
| 1599491 | 8/1970 | France . |

*Primary Examiner*—Harold J. Tudor

*Attorney, Agent, or Firm*—Foley & Lardner

[57] ABSTRACT

A rifle grenade includes a head with an axial bore and a tail with a bore that is continuous with the axial bore of the head. The chamber divides the tail into front and rear portions. The chamber has a lateral wall with a cavity formed therein. A bullet passage plug is elastically fitted in the chamber and is axially movable between rear and front positions. The cavity contains a charge in addition to the main explosive charge of the grenade.

5 Claims, 1 Drawing Sheet

PROJECTILES

BACKGROUND OF THE INVENTION

The invention relates to improvements to projectiles, notably of grenades, designed to be launched by means of a weapon, for example a rifle, utilizing conventional bullet cartridges.

Known projectiles of this type are generally provided with a head containing an explosive charge, this head being extended by a tubular tail capable of being mounted on the barrel of a rifle.

In a first application, a projectile launching mode requires the utilization of special propulsion cartridges without bullets, which causes difficulties at the level of the Army Service Corps, a lack of operational efficiency when a normal cartridge is used in the rifle for launching a projectile, and a serious danger for the operator in case of mistake in the choice of ammunition or the condition of the weapon with the launching of a projectile.

In another application, the launching of projectiles can be achieved with the assistance of a normal bullet cartridge, nevertheless, such an application requires a bullet trap provided in the tubular tail.

These bullet traps are generally of delicate construction and onerous for they must, with maximum security, catch and hold the bullet when a shot is fired without pernicious deformation, even rupture, of the aforementioned tubular tail. In order to absorb the kinetic energy of the bullet as well as the heat resulting from its capture, without deformation of the tail of the projectile, these bullet traps consist of a succession of screens designed to slow down and to immobilize the bullet or they consist of rather considerable metallic masses. These bullet traps have, among others, the disadvantage of a not inconsiderable weight and encumberance.

In yet another application the launching of projectiles can be achieved by means of a normal bullet cartridge, the projectiles for this purpose having, from one end to the other, an axial passage permitting the bullet to traverse the projectile or grenade and to escape to the exterior.

Applications of this type are described in the French patent no, 1.599.491 as well as in the German patent application no. 25 54 049.

This alluring conception offers the disadvantage of causing a loss of efficiency due to the fact that the propulsive gases can also escape from the aforementioned German patent application no. 25.54.049 — a complex obturating mechanism designed to obturate the aforementioned bore immediately after the passage of the bullet. From the point of view of economy, such an obturation device is probably not less onerous than a bullet trap. Moreover, as this obturator only begins to function following a mechanical effect exerted by the bullet during its passage, a projectile or grenade thus equipped, cannot be fired with propulsion cartridges without bullets, except with a very low efficiency, and, therefore, a profound modification of the firing conditions.

In order to remedy these disadvantages and to provide a solution to the aforementioned problems a bullet passage plug has already been proposed which can easily be traversed by the aforementioned bullet, and which closes after the passage of the bullet in order to prohibit all passage of propulsive gases.

Notwithstanding that the propulsive gases produced by the firing of the cartridge result in the launching of the aforementioned projectile or grenade by exerting an adequate force on the closed bullet passage after the passage of the bullet, it has been proven more efficient to provide an additional charge which can add to the effect of the propulsive gases mentioned above in order to result in a more considerable force on the bullet passage plug particularly a larger launching force.

SUMMARY OF THE INVENTION

The invention, therefore, relates to a rifle grenade having plug bullet passage, particularly a mobile bullet passage plug, permitting the use of such an additional charge.

For this purpose the rifle grenade according to the present invention, comprises a head extended by a tubular tail and traversed tail. A bullet passage plug is mounted in a chamber in the rear part of the aforementioned axial bore. The bullet passage plug is arranged in such a manner that, in the storage position of the projectile, the bullet passage plug, is in the aforementioned chamber at a certain distance from the back of the aforementioned chamber, confining at its circumference, an additional charge.

BRIEF DESCRIPTION OF THE DRAWINGS

In order to show better the characteristics and advantages of the present invention, an example of the embodiment of the latter is described in greater detail hereafter with reference to the enclosed illustrating drawings in which.

DESCRIPTION OF THE PREFERRED EMBODIMENTS

Figure 1:
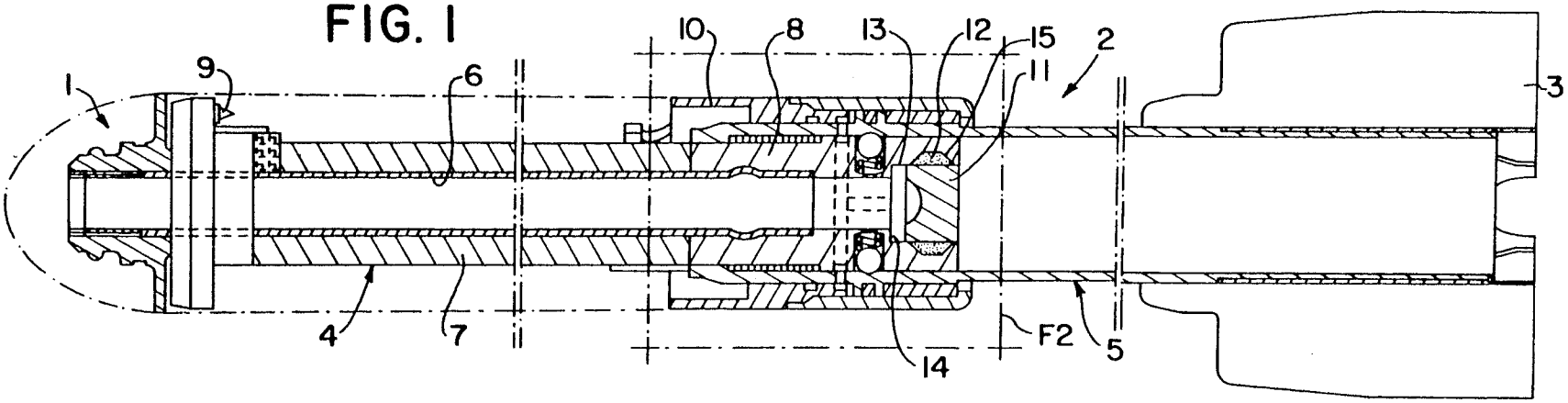
FIG. 1 represents in schematic longitudinal section a projectile, particularly a grenade, having a bullet passage plug according to the present invention.
Figure 2:
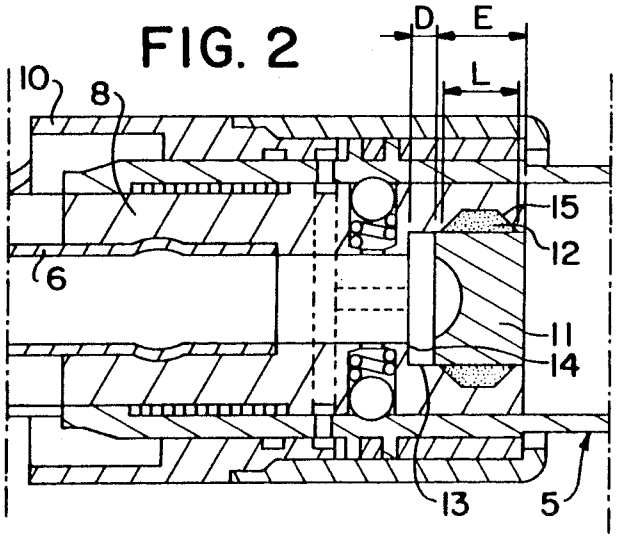
FIG. 2 represents on a larger scale the part indicated by F2 in FIG. 1.

In FIG. 1 a projectile comprising a head 1 and a telescopic tail 2 with fins 3 is represented. In this embodiment the tail 2 is in two parts, namely a part 4 joined to the head 1 and a part 5 which can slide the length of part 4.

The head 1 is attached to the front extremity of a sleeve 6 around which a body 7 constituting the explosive charge of the projectile is provided, the rear extremity of the aforementioned sleeve 6 being provided with a muff 8 by which the aforementioned part 4 can be immobilized with the aforementioned part 5 awaiting the passage of the bullet.

The rear extremity of the muff 8 is obtruded by a bullet passage plug 11 around which an additional charge 12 is disposed.

At the time of its installation, the bullet passage plug 11 is compressed in the chamber 13 so that, on the one hand, it is held in place without other means than the pressure which it exerts on the wall of the chamber 13 and that, on the other hand, it ensures a perfect tightness, the bullet passage plug only being able to be moved in the chamber 13 by a very considerable force, for example, the force exerted on the bullet passage plug by a launching bullet.

According to the invention the bullet passage plug 11 is lodged in the chamber 13 at a distance D from the back 14, the thickness E of the aforementioned bullet passage plug 11 being greater than the length L of the aforementioned additional charge 12, in such a manner that this additional charge is totally confined in the circular cavity 15 by the bullet passage plug 11 itself.

The bullet passage plug 11 will be advantageously, made of a supple, elastic substance, either natural or synthetic, preferably with a hardness situated between approximately 30 Shore A and approximately 70 Shore D.

It has effectively been established that the passage of a bullet through such a bullet passage plug causes practically no disappearance of matter, whether by tearing, fusion, or combustion, this on condition of shaping the aforementioned bullet passage plug so that it can dilate sufficiently during the passage plug of the bullet. Moreover, it is desirable that this dilation causes no appreciable deformation of the wall delimiting the bore in which the bullet passage plug is provided.

Figure 3:
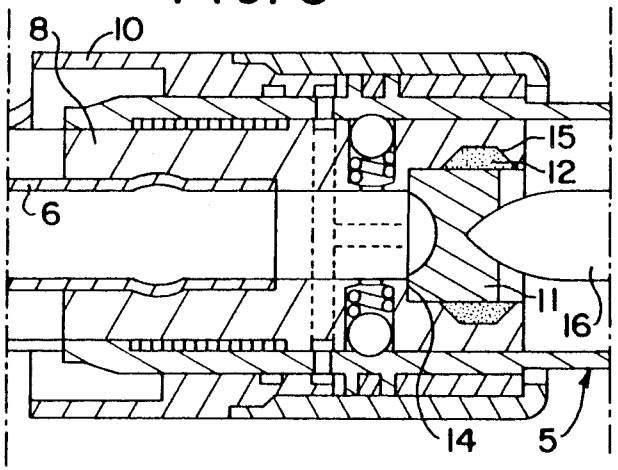
FIG. 3 represents a view similar to that of FIG. 2, the bullet passage plug being in a second position.

As it has been represented in FIG. 3, the mobile bullet passage plug according to the invention will be moved forward, by contact of the bullet 16 with the bullet passage plug 11 in order thus to discharge, even prior to the total penetration of the bullet 16 through the bullet passage plug 11, the additional charge 12 in such manner that the effect of the deflagration of the additional charge 12 adds to the effect of the combustion gases of the ordinary cartridge utilized for launching the projectile by means of the bullet 16.

In order to be able to confine the additional charge 12 the thickness E of the bullet passage plug 11 is slightly larger than the width L of the cavity 15 confining the additional charge 12, whereas, in order to be able to discharge this additional charge after a forward movement of the bullet passage plug 11, the distance D between the bullet passage plug 11 and the back 14 of the chamber 13 is greater than half the difference between the thickness E of the bullet passage plug 11 and the width L of the cavity 15.

It is clear that a mobile bullet passage plug according to the invention, confining an additional charge during its storage and discharging this additional charge at the time of launching of the projectile of which it is part, can be embodied in different forms.

I claim:

1. A rifle grenade comprising:

a head provided with an axial bore;

a tail having an axial bore continuous with the axial bore of the head, the tail comprising a chamber located in a part of the tail away from the head, the chamber dividing the bore in the tail into a front portion and a rear portion and having openings formed in both front and rear portions, the chamber further having a lateral wall provided with a cavity;

a bullet passage plug axially movable inside the chamber between a rear storage position wherein the bullet passage plug closes off the opening in the rear portion of the bore in the tail and the cavity in the lateral wall of the chamber is closed to the rear portion, and a front position wherein the opening into the rear portion is opened and the cavity in the lateral wall of the chamber is at least partially opened into the rear portion; and a charge inside the cavity.

2. A rifle grenade according to claim 1, wherein a thickness of the bullet passage plug is slightly larger than a width of the cavity confining the charge.

3. A rifle grenade according to claim 1, in which a distance between the bullet passage plug and the back of the chamber is greater than half the difference between the thickness of the bullet passage plug and the width of the cavity.

4. A rifle grenade according to claim 1, wherein the bullet passage plug is made of a substance having a hardness between about 30 Shore A and about 70 Shore D.

5. A rifle grenade according to claim 1, wherein the bullet passage plug is held in the chamber by an elastic force of the plug exerted on the wall of the chamber.

* * * * *

UNITED STATES PATENT AND TRADEMARK OFFICE

CERTIFICATE OF CORRECTION

PATENT NO. : 5,153,374

DATED : October 6, 1992

INVENTOR(S) : A. GABRIELS

It is certified that error appears in the above-identified patent and that said Letters Patent is hereby corrected as shown below:

Column 1, line 50, after "aforementioned" insert --bore, except by providing—as in the aforementioned--.

Column 2, line 18, after "traversed" insert --by an axial bore which exists in the aforementioned tubular--.

Signed and Sealed this

Twenty-sixth Day of October, 1993

*Attest:*

*Attesting Officer*

BRUCE LEHMAN

*Commissioner of Patents and Trademarks*